United States Patent [19]

Vermeulen et al.

[11] 4,136,014

[45] Jan. 23, 1979

[54] METHOD AND APPARATUS FOR SEPARATION OF BITUMEN FROM TAR SANDS

[75] Inventors: Frederick E. Vermeulen, Edmonton; Frederick S. Chute, Sherwood Park, both of Canada

[73] Assignee: Canadian Patents & Development Limited, Ottawa, Canada

[21] Appl. No.: 851,169

[22] Filed: Nov. 14, 1977

Related U.S. Application Data

[63] Continuation-in-part of Ser. No. 705,991, Jul. 16, 1976, abandoned.

[30] Foreign Application Priority Data

Aug. 28, 1975 [CA] Canada ..... 234394

[51] Int. Cl.[2] ..... C10G 1/04

[52] U.S. Cl. ..... 208/11 LE; 204/190

[58] Field of Search ..... 166/248; 208/11 R, 11 LE; 204/190

[56] References Cited

U.S. PATENT DOCUMENTS

| | | | |
|---|---|---|---|
| 2,009,366 | 7/1935 | Wait | 208/11 LE |
| 3,782,465 | 1/1974 | Bell et al. | 166/248 |
| 3,862,662 | 1/1975 | Kern | 166/248 |

FOREIGN PATENT DOCUMENTS

| | | | |
|---|---|---|---|
| 561709 | 8/1958 | Canada | 208/11 |
| 2427031 | 12/1975 | Fed. Rep. of Germany | 166/248 |
| 321910 | 11/1929 | United Kingdom | 208/11 |

*Primary Examiner*—Herbert Levine

*Attorney, Agent, or Firm*—James R. Hughes

[57] ABSTRACT

Method and apparatus for separation of bitumen from tar sands involving an electric flotation cell formed of a container in which is placed a charge of unseparated tar sand to a first level and which is then filled with water to a second level and electrodes positioned in the cell in relation to the tar sand such that on application of a voltage to the electrodes an electric current flows through the tar sand and water. It has been found that after application of the electrical energy to the tar sands agitation and then separation takes place with the bitumen being floated to the upper surface.

5 Claims, 6 Drawing Figures

METHOD AND APPARATUS FOR SEPARATION OF BITUMEN FROM TAR SANDS

This application is a continuation-in-part of application Ser. No. 705,991, filed July 16, 1976 now abandoned.

This invention relates to a method and apparatus for extraction or separation of bitumen from tar sand and more particularly to an electric flotation cell for carrying out the separation.

Tar sand has been defined as sand saturated with a highly viscous crude hydrocarbon material not recoverable in its natural state through a well by ordinary production methods. Tar sand, which should probably be called bituminous sand since the hydrocarbon is a bitumen (i.e. a carbon disulfide-soluble oil), is a mixture of sand, water, and bitumen. The sand component is predominantly quartz in the form of rounded or subangular particles each of which is wet with a film of water. Surrounding the wetted said grains and somewhat filling the void volume among them is a film of bitumen. The balance of the void volume is filled with water or sometimes gas. The extraction or separation of the bitumen from the sand has been an intriguing but economically difficult problem for many years. At the present time the only economic method of extraction is the Hot Water Process developed by Dr. K. A. Clark at the Alberta Research Council and used commercially at Fort McMurray, Alberta, on the Athabasca oil sand.

There have been a large number of proposals of various kinds for electrically heating the tar sands in situ. One such method is described in U.S. Pat. No. 3,862,662, dated Jan. 28, 1975 and entitled "Method and Apparatus for Electrical Heating Of Hydrocarbonaceous Formations". Other patents concerned with this approach are U.S. Pat. Nos. 3,848,671; 3,857,776; 3,782,465; 3,718,186 and 3,642,066.

It is an object of the present invention to provide a method and apparatus for separation of bitumen from tar sand which is relatively economic and which does not require excessive amounts of hot water.

This and other objects of the invention are achieved by a method and apparatus involving an electric flotation cell formed of a container in which is placed a charge of unseparated tar sand to a first level and which is then filled with water to a second level and electrodes positioned in the cell in relation to the tar sand such that on application of a voltage to the electrodes an electric current flows through the tar sand and water. It has been found that after application of the electrical energy to the tar sands agitation and then separation takes place with bitumen being floated to the upper surface.

The water may be put into the cell first or both the water and the tar sand at the same time.

Figure 2:
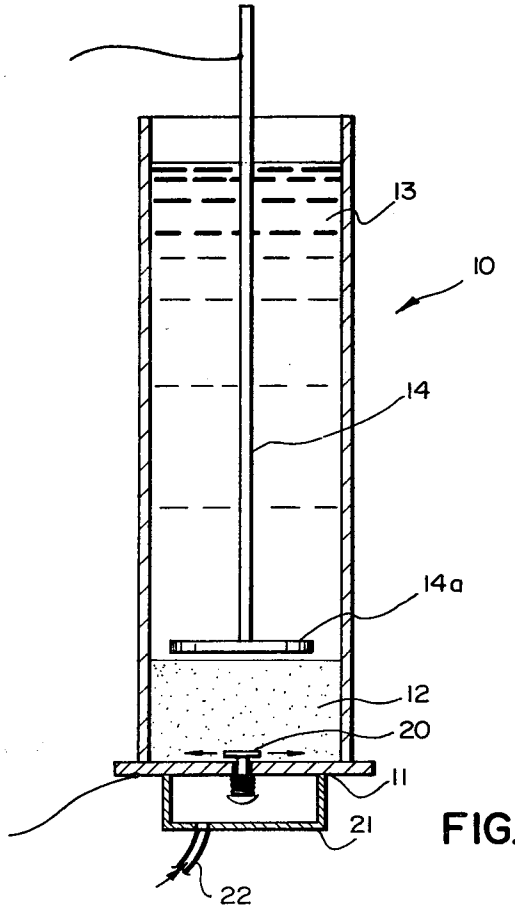
Figure 1:
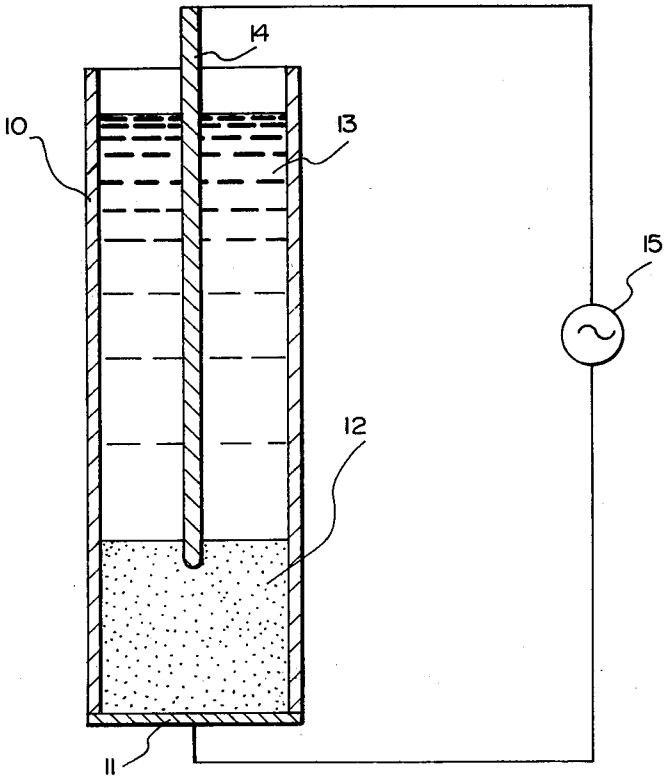
Figure 6:
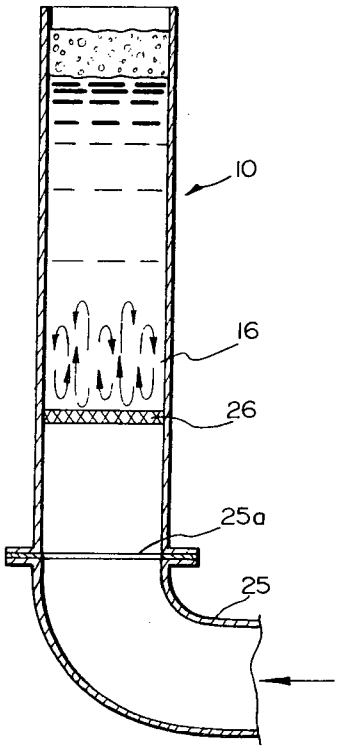
Figure 5:
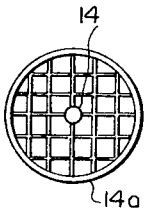
Figure 4:
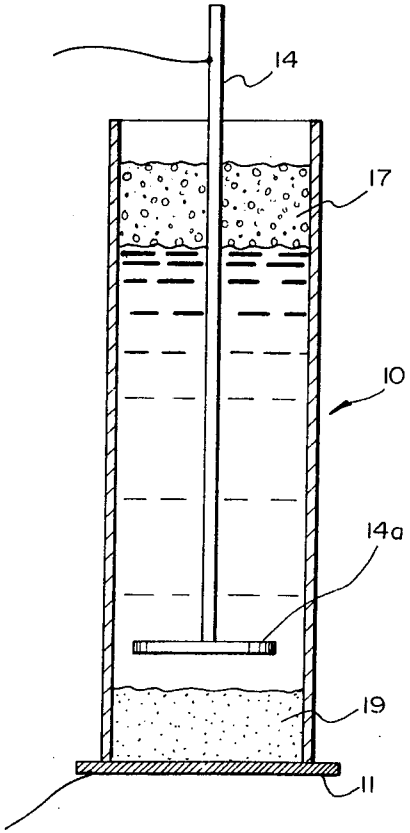
Figure 3:
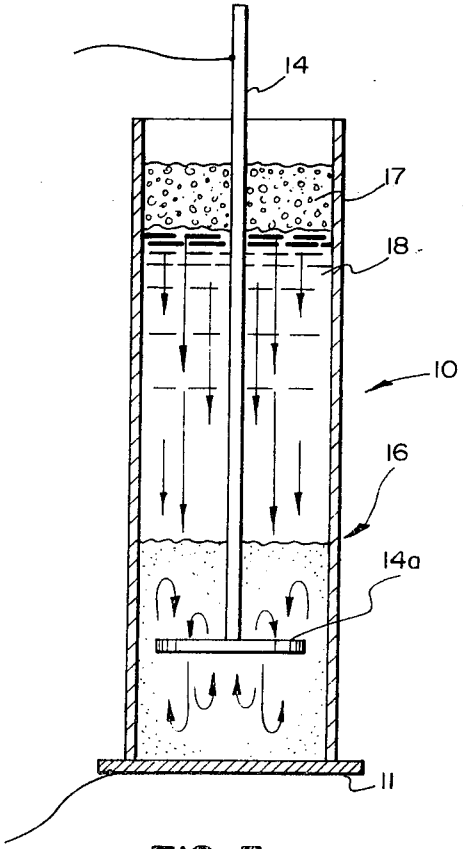

In drawings which illustrate embodiments of the invention,

FIG. 1 is a schematic view of a floatation cell with electrodes,

FIG. 2 is a cross-section of an experimental cell at the start of the separation process, FIG. 3 is similar to FIG. 2 but after the process has proceeded for a time, FIG. 4 is similar to FIGS. 2 and 3 but shows the process after completion, FIG. 5 shows a typical form of upper electrode for the cell, and FIG. 6 shows an alternative method of applying electrical energy to the cell, usable at microwave frequencies.

Referring to FIG. 1 a schematic view of an electric flotation cell is shown generally as a cylindrical container 10 made of insulating material e.g. glass, perspex. The bottom of the cell 11 is a metal plate acting as one electrode. It is also possible to operate with a "CAN" shaped lower electrode. This latter form would have certain advantages in that the portion of the cell containing the tar sand charge and subject to highly abrasive agitation would be of metal. The cell is filled with a charge of raw tar sand 12 and filled with water 13. A metal electrode 14 is positioned centrally in the container and touches or is close to the upper surface of the tar sand. An electric voltage is applied from a suitable power source 15 across the electrodes. It has been found that the frequency of operation can be from DC to high frequency RF and even into the microwave range. The latter of course requires a special type of applicator. Standard mains frequency of 60 cycle has been found to operate successfully.

FIGS. 2, 3 and 4 show stages in operation of an experimental cell. In FIG. 2 a charge of tar sand 12 is placed in the cell and covered with water to a predetermined depth. Although the process will operate with a depth of water less than that of the tar sand, it has been found preferable to use a depth one or more times that of the tar sand. The upper electrode which is in the form of a metal grid **14*a* fastened to the end of the central conductor 14 rests near the upper surface of the tar sand. A voltage in the range of one to several thousand volts at 60 Hz is applied to conductor 14 and bottom plate electrode 11 resulting in an intense electric field through the tar sand layer and a current of one to several amperes. This causes violent agitation of the tar sand and water to a level 16 as shown in FIG. 3 with a froth layer 17** forming on the upper surface of the water.

Conduction in the tar sand takes place along relatively high resistance filamentary paths of pore water. The water in the filamentary paths rapidly turns into steam which tends to loosen the consolidated tar sand charge, until quite suddenly the charge of tar sand begins to break up. At this point the impedance between the electrodes drops sharply and the voltage is reduced to maintain a steady current. The tar sand now enters a roiling phase in which the tar sand material between the electrodes is violently agitated. The roiling action rapidly spreads to engulf the lower portion of the upper lectrode but depending on the actual current, it can be confined to a region well below the top of the water column. In practice a rather well defined and stable boundary 16 can be maintained between the agitated tar sand and the water column 18 above. Sand and bitumen particles are continually ejected from the agitated zone. However, the sand particles rise only a short distance and then fall back through region 18 towards the bottom of the vessel. On the other hand the bitumen particles float freely to the top of the water column where they agglomerate to form a froth 17. It is believed that the bitumen films begin to rupture when the tar sand is initially heated, and that the ensuing particle collisions during the roiling phase provide shearing forces which then peel the bitumen films from the sand grains. The bitumen particles float readily since they entrain gas bubbles and water vapor which are released from the tar sand and at the electrodes during agitation.

At the end of a few minutes the separation process is terminated and the cell appears as in FIG. 4 with a deep flotation layer 17 at the top and a sand residue 19 at the bottom. At this point the temperature of the water in the separation level is typically 160° F. to 180° F. If desired the cell can be left for a period e.g. several minutes to one hour or more to achieve settling and clarification of water.

Because the water is heated during the process it is economic to reuse the water as often as possible. The froth on the top of the liquid column entrains and contains a relatively high percentage of the bitumen with the sand, clays and other residues remaining at the bottom. This flotation layer can be readily removed and passed to further processing stages.

The voltage and current levels at which the separation is carried out and the time duration of the process vary somewhat depending upon the grade of tar sand which is being processed. If the rate of heating is too large, the tar sand near the bottom electrode has a tendency to dry out and current conduction stops. This problem, and also the problem of reduced current flow due to partial coating of the bottom electrode with insulating bitumen when processing very rich tar sand, were solved by installing a water flooding valve in the center of the bottom electrode. This valve 20, as shown in FIG. 2, is normally held closed by a spring. Upon momentarily increasing the pressure in the water reservoir 21 connected to inlet 22 below the bottom electrode the valve opens and a horizontal sheet of water is driven along the top surface of the bottom electrode. This action provides a low impedance interface between the electrode and the charge of tar sand and conduction is reestablished. The valve is self cleaning and does not clog. Once the roiling phase has been initiated, the scouring action of the sand particles keeps all electrodes clear of bitumen.

It is also considered that it would be advantageous to the process to use additives to control the pH value of the cell contents. A typical additive would be NaOH.

The upper electrode can be in various shapes the simplest being the rod of FIG. 1. A grid shaped structure as shown in FIG. 5 appears to be quite effective.

FIG. 6 illustrates a suitable means of applying microwave energy to column 10. Waveguide 25 connected to a microwave power source (not shown) is connected to the bottom of the cell through a plate 26 which is such as to allow passage of the energy into the tar sand 16.

Preliminary data has been obtained on tests conducted on tar sand separation using the electric flotation cell described above. The following is a typical test run on a laboratory model showing material and energy balances:

TYPICAL TEST RUN

1. A 2.0 kgm charge of tar sand was mixed with 200 ml $H_2O$ and placed in the separator with 5l of $H_2O$ at 75° F. The resulting water column height was approximately 10 inches. Separation required a total electrical energy input of 0.4 Kw-hr. The original charge when mixed with 200 ml of $H_2O$ consisted of 12.2% Bitumen, 10.1% $H_2O$ and 77.7% solids (sand and clay fines). The upgraded bitumen consisted of 54.4% of Bitumen, 31.9% $H_2O$ and 13.7% solids. The tailings consisted of 1.3% Bitumen, 20.4% $H_2O$ and 78.3% solids.

2. Materials Balance (to nearest gram)

| | | |
|---|---|---|
| INPUT | | |
| (a) feed stock | Bitumen | 268 gm |
| | $H_2O$ | 222 gm |
| | solids | 1709 gm |
| (b) process water (75° F) | | 5000 gm |
| OUTPUT | | |
| (a) upgraded bitumen | Bitumen | 241 gm |
| | $H_2O$ (165° F) | 141 gm |
| | solids | 61 gm |
| (b) tailings | Bitumen | 27 gm |
| | $H_2O$ (165° F) | 430 gm |
| | solids | 1648 gm |
| (c) reuseable water (165° F) | | 4651 gm |

3. Electrical Energy Input: $3.44 \times 10^5$ cal $(0.4 \text{ kw-hr} \times 8.6 \times 10^5 \frac{\text{cal}}{\text{kw-hr}})$ (b) Heat Value of Recovered Bitumen: $2.24 \times 10^6$ cal $(241 \text{ gm} \times 0.93 \times 10^4 \frac{\text{cal}}{\text{gm}})$ (c) $\frac{\text{Heat Value of Recovered Bitumen}}{\text{Electrical Energy Input}} = 6.5$ (d) Percentage of Bitumen Unrecovered $(\frac{\text{Bitumen in tailings}}{\text{bitumen in feedstock}} = 10\%$ The results for many such test runs showed that with approximately 5000 ml of process water the bitumen froth consisted on the average of 56% bitumen, 29% water and 15% solids. However, variations from these averages by as much as 15 to 20% were encountered from sample to sample because of the wide range of sample compositions. For example, individual tar sand samples ranged from 10–18% bitumen, 1–5% water and 81–85% solids. By way of comparison with the Clark hot-water process, average values for the separated bitumen froth have been given in the literature as 49% bitumen, 42% water and 9% solids for tar sand feedstock consisting of 13% bitumen, 4% water and 83% solids.

The following are average results for a series of tests with different water-column heights. It should be pointed out that, although the trends are readily apparent, the wide range of constituent makeups in handling small samples results in deviations from these average results by as much as 15%.

AVERAGE RESULTS

1. Water column height between 20–24 inches (~10–12l $H_2O$)
(a) sample size 2000 gm
(b) average recovered bitumen 213 gm
(c) average electrical energy input 0.52 kw-hr.

| | | |
|---|---|---|
| (d) average upgraded bitumen | Bitumen | 69% |
| | $H_2O$ | 22.5% |
| | Solids | 8.5% |

(e) average of $\frac{\text{heat value of recovered bitumen}}{\text{electrical energy input}} = 4.4$ 2. Water column height 4 inches (2l$H_2O$)
(results of a single test)
(a) sample size 2200 gm
(b) recovered bitumen 128.2 gm
(c) electrical energy input .37 kw-hr

| | | |
|---|---|---|
| (d) upgraded bitumen | Bitumen | 49.7% |
| | $H_2O$ | 32.6% |
| | Solids | 17.7% |

(e) $\frac{\text{Heat value of recovered bitumen}}{\text{Electrical energy input}} = 3.7$ This inherent flexibility in the amount of process water required could be a distinct advantage when availability or disposal of large quantities of process water is difficult. The relatively high sand content in the bitumen froth obtained when using very small quantities of process water need not be of major concern as synthetic crude oil would be obtained from high sand content froth using a direct coking technique.

RECYCLING

It is important to note that the energy costs of producing the bitumen have been calculated by assuming that each sample requires fresh water that must be heated. However, the bulk of the water column is reuseable several times and for each successive sample separated the energy cost will be reduced.

One such test of recycling was carried out and the results are summarized below:

| | |
|---|---|
| 1st sample: | |
| | (a) recovered bitumen 181.5 gm |
| | (b) electrical energy input 0.45 kw-hr |
| | (c) $\frac{\text{heat value of recovered bitumen}}{\text{electrical energy input}} = 4.4$ |
| 2nd sample | |
| | (a) recovered bitumen 116.6 gm |
| | (b) electrical energy input 0.13 kw-hr |
| | (c) $\frac{\text{heat value of recovered bitumen}}{\text{electrical energy input}} = 9.8$ |
| 3rd sample: | |
| | (a) recovered bitumen 88 gm |
| | (b) electrical energy input 0.08 kw-hr |
| | (c) $\frac{\text{heat value of recovered bitumen}}{\text{electrical energy input}} = 12$ |

The limit to water recycling has not yet been determined, put presumably beyond a certain point the bitumen will become excessively sandy as the residual silt load in the water column increases.

It is pointed out that the predominant part of the electrical energy used in the electrical separation technique is required to heat the process water to a temperature of 160° to 180° F. (note that this energy need not be obtained electrically and a less costly form of energy could be used to preheat the water). Thus a rough comparison of the energy efficiencies of the hot-water process and the electrical separation cell can be made by simply comparing the relative amounts of process water that must be replenished and heated during separation. The tests mentioned above indicate that, with recycling, the water requirements of the electrical separation cell, expressed as a weight ratio of water required to bitumen produced, is of the order of 3-4. By way of comparison the hot-water process requires a ratio of approximately 9. Thus the electrical separation cell potentially offers substantial reductions in water and energy requirements.

Although the above description of the process is generally in regards to a "batch" process, it will be realized that the invention also covers a continuous or "flow" process. This would simply require the continuous feeding of the stock of bituminous sand to the apparatus with simultaneous removal of froth, water, and tailings.

The type and frequency of the applied electrical energy may vary over fairly wide ranges depending on the specific cell design parameters. The following points outline the energy and frequency requirements.

(i) frequency of operation: 60 Hz to 2450 MHz. This range thus includes power frequencies, radio frequencies and microwave frequencies.
(ii) voltage levels at power and radio frequencies for the laboratory cell: 1000–12,000 volts.
(iii) current levels at power and radio frequencies for the laboratory cell: 1–5 amperes.
(iv) at microwave frequencies it is not meaningful to talk of voltage and current levels across the cell and it is customary to record only the average power levels which for the experimental laboratory cell varied from several hundred watts to approximately one kilowatt.
(v) the voltage, current and power levels may or may not need to be scaled as the size of the separation cell is increased depending on what height to diameter ratio is used for the cell.

We claim:

1. A method of separation of bitumen from tar sands comprising:
(a) placing a charge of unseparated tar sand to a first level and an amount of water to a second level in a container,
(b) applying electrical energy to the tar sand, such that an electric current passes through the tar sand and the water,
(c) continuing the application of electrical energy until the tar sands and water have been agitated, mixed and the bitumen separated from the sand, and floated upward to the top of the water, and
(d) removing the flotation layer for further processing, said layer containing a high proportion of the bitumen occuring in the charge of tar sand.

2. A separation method as in claim 1 wherein the method of applying electrical energy to the tar sand is by means of electrodes placed at two positions in relation to the tar sand.

3. A separation method as in claim 1 wherein the method of applying electrical energy to the tar sand is by applying microwave energy directly to the tar sand.

4. A separation method as in claim 1 wherein the amount of water placed in the container results in a level of water above the tar sand one or more times that of the sand.

5. A separation method as in claim 1, further comprising the step of controlling the pH level of the tar sand and water by means of additives.

* * * * *